United States Patent [19]

Flagg

[11] 4,440,342

[45] Apr. 3, 1984

[54] HEAT DISPERSING THERMAL BARRIER

[76] Inventor: Rodger H. Flagg, 1415 Lynn Ave., Ft. Wayne, Ind. 46805

[21] Appl. No.: 250,055

[22] Filed: Apr. 1, 1981

[51] Int. Cl.[3] ..... F24D 5/00

[52] U.S. Cl. ..... 237/50; 98/33 A; 237/52; 126/131

[58] Field of Search ..... 237/46, 50, 51; 126/67, 126/61, 19 R, 22, 21 A, 131; 98/33 A, 40 VM

[56] References Cited

U.S. PATENT DOCUMENTS

| | | | |
|---|---|---|---|
| 3,182,579 | 5/1965 | Wiseman | 98/40 VM |
| 4,125,354 | 11/1978 | Andrews | 126/19 R X |
| 4,168,797 | 9/1979 | Luke | 98/33 A |
| 4,206,804 | 6/1980 | Scholtes | 126/67 |
| 4,337,894 | 7/1982 | Shupe | 237/46 |

OTHER PUBLICATIONS

Thrifty Therm, Fuel Master Inc., Trenton Ga., 1980.

*Primary Examiner*—Albert J. Makay
*Assistant Examiner*—Henry Bennett
*Attorney, Agent, or Firm*—Rodger H. Flagg

[57] ABSTRACT

A heat dispersing thermal barrier, adapted for installation in close proximity to a free-standing heating device, comprising a vertically disposed, heat resistant room confronting wall panel, adapted to be spaced apart from the room wall by extensions to form a plurality of vertically aligned fluid passages between the extensions, the room confronting panel, and the wall confronting side of the thermal barrier. The fluid passages extend from near the ceiling to near the floor, with one end of the fluid passages in fluid communication with a chamber, wherein a blower is adapted to be in fluid communication with the chamber and the room air, and positioned to draw room air from near the ceiling, downwardly through the fluid passages to exhaust the air into the room near the floor. The blower may be thermostatically controlled. The chamber may be adapted to extend to provide thermal protection to the room floor and/or ceiling in proximity to the free-standing heating device. The thermal barrier may be adapted for corner installation. Thermal insulation may be adapted to be secured to the barrier to provide improved thermal protection to allow for closer positioning of the heating device to the thermal barrier to conserve valuable room space.

15 Claims, 13 Drawing Figures

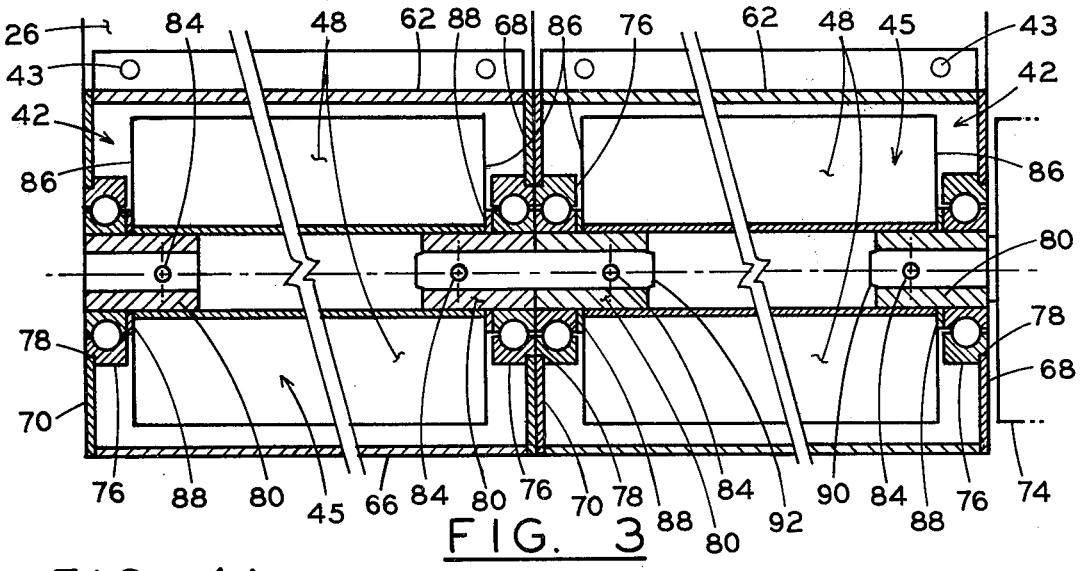
FIG. 3
FIG. 4A
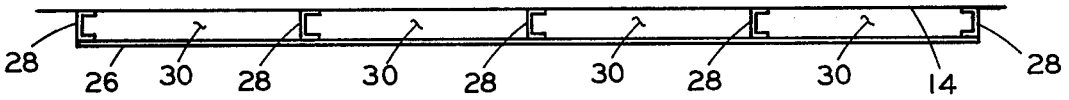
FIG. 4B
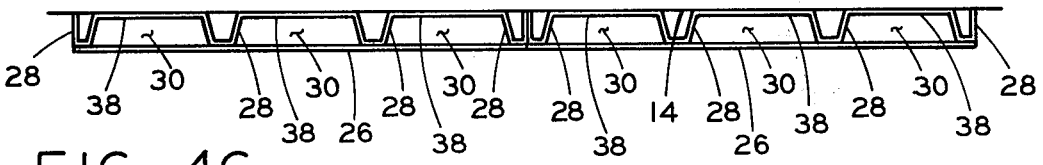
FIG. 4C
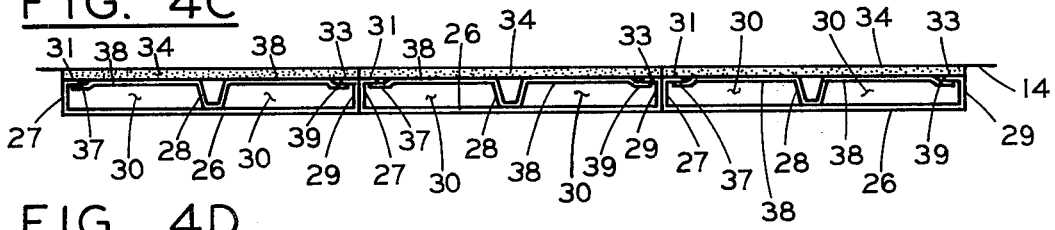
FIG. 4D
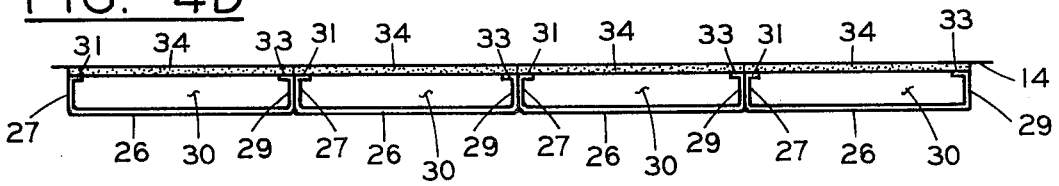
FIG. 4E
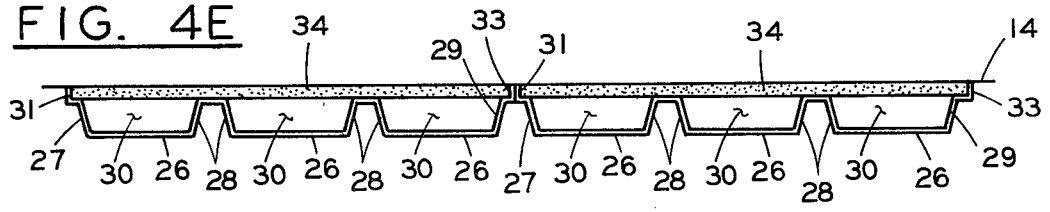

FIG. 5
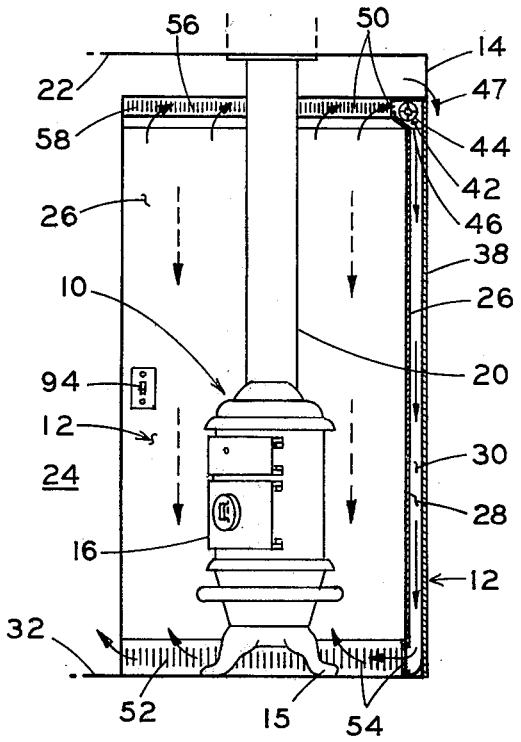
FIG. 6
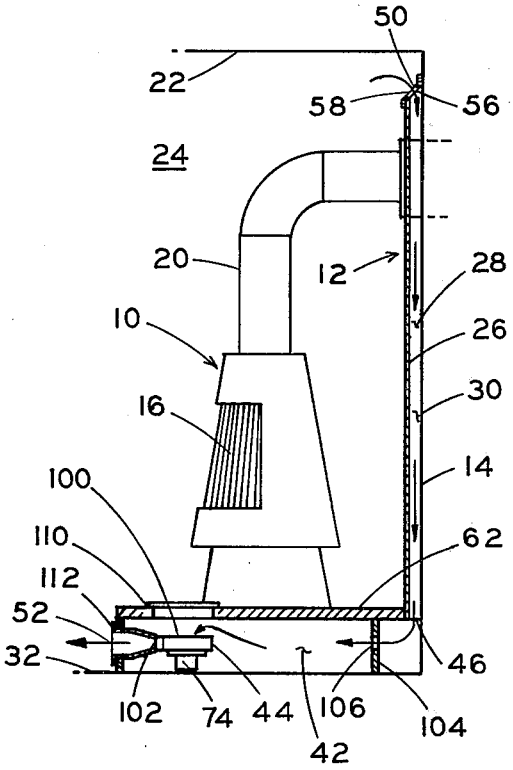
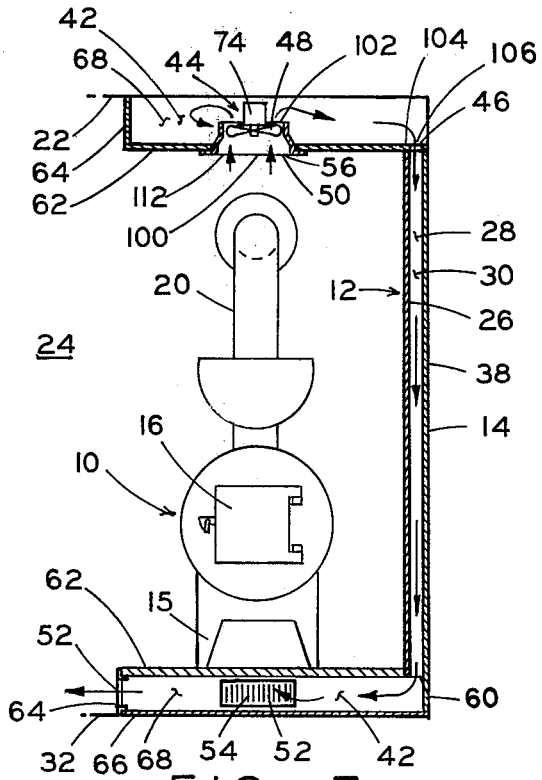
FIG. 7
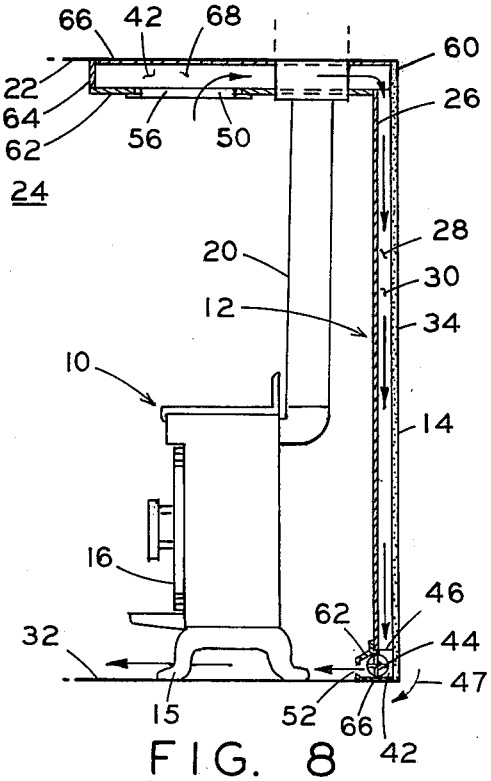
FIG. 8

HEAT DISPERSING THERMAL BARRIER

BACKGROUND OF THE INVENTION

1. Field of the Invention

This apparatus relates generally to thermal barriers in proximity to free-standing heating devices. More specifically, to thermal barriers adapted with a blower to actively disperse heated air in proximity to a heating device, wherein room air is drawn from near the ceiling, down through a plurality of vertically aligned fluid passages, and exhausted into the room, near the floor.

2. Description of the Prior Art

Free-standing heating devices can be a serious fire hazard when installed too close to combustionable room materials, such as are commonly found in floors, walls, and ceilings of conventional dwellings. Due to the recent increase in fuel costs, free-standing stoves and fireplaces are rapidly gaining in popularity and use. Such installations are especially dangerous when improperly installed by a consumer who has little knowledge of proper installation procedures. Those skilled in the art know that by spacing a heat resistant material from a combustionable wall in proximity to a free-standing heating device, to create an air space therebetween, provides a more efficient thermal installation than can be achieved by securing the same heat resistant material directly against the combustionable wall. Thermal barriers have long been commercially available using a heat resistant material such as sheet metal, sometimes backed by heat resistant insulation board, adapted to be spaced from the wall. Use of such barriers allows closer placement of the heating device in relation to the room wall to conserve room space.

Spaces between the wall and the heat resistant material, were at times provided with openings near the floor and ceiling to allow the air to rise by natural convection through such spaces, to transfer heat from the heat resistant wall to the passing air. One problem with such installations is the accumulation of heat near the ceiling, which is not provided with a positive means of circulating the heated air to the floor, where it is needed for occupant comfort.

Since heat rises by natural convection, it has also long been known that room temperature near the ceiling is normally hotter than the temperature near the floor.

One commercial device secures a blower to the exhaust flue of a heating device to actively direct air down toward the floor in the vicinity of the heating device. While such a device is useful, it does not solve the problem of actively dispersing radiant heat passing from a heating device to nearby combustionable walls, ceilings and/or floors, nor does it allow a free-standing heating device to be safely positioned closer to combustionable walls, to conserve room space.

SUMMARY OF THE INVENTION

Therefore, what is needed is a thermal barrier adapted for securement to combustionable walls, in proximity to a free-standing heating device, which may be readily adapted to provide thermal protection to combustionable floors and/or ceilings, that actively disperses radiant heat passing by conduction through the thermal barrier, and actively disperses the heated air by convection to the forced air passing downwardly through apertures in the thermal barrier, drawing the heated air from near the ceiling and dispersing the heated air near the floor, to improve heat transfer within the thermal barrier, while allowing closer positioning of the heating device to the thermal barrier, to conserve room space, while providing a means for actively dispensing heated room air from the ceiling to the floor, for improved occupant comfort.

One object of this invention is to provide an improved thermal barrier for installation in proximity to a free-standing heating device.

Another object is to provide an improved thermal barrier adapted to actively disperse room air in proximity to a heating device from near the ceiling, downwardly through vertically aligned fluid passages in the thermal barrier, and to exhaust the heated air from the thermal barrier into the room, near the floor.

Another object is to provide a thermostatic control to actuate a blower when temperature and proximity to the thermal barrier exceeds desired room temperature, to automatically draw air downwardly from near the ceiling, through fluid passages in the thermal barrier, for dispersement near the floor to improve heat transfer from the thermal barrier to the passing air.

Another object is to provide thermal protection to combustionable floors in proximity to a heating device by extending the base of the thermal barrier to support the heating device thereon.

Yet another object is to provide thermal protection to a combustionable ceiling in proximity to a free-standing heating device by extending the thermal barrier above the heating device.

Still another object is to provide an improved, protective thermal barrier for a free-standing heating device, which is adaptable to be mass produced and easily and economically installed at the site.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 3 is a partial, cross-sectional view of the blower shown in FIG. 2 detailing the preferred mounting of the blower within several chambers;

FIGS. 4*a* through 4*e* are partial top elevation views of the wall partition detailing various combinations of thermal barriers and extensions to provide fluid passages therethrough;

FIG. 5 is a side cross-sectional view of the thermal barrier with the blower adapted to be positioned near the ceiling wherein the barrier is adapted to protect nonaligned adjoining combustionable room walls in proximity to the heating device;

FIG. 6 is a side cross-sectional view of a thermal barrier adapted with the chamber extended beneath the heating device to provide thermal protection to a combustionable wall and adjoining combustionable floor;

FIG. 7 is a side elevation view of the thermal barrier adapted to extend above and beneath the heating device to provide thermal protection to combustionable floor, walls and ceiling in proximity to the heating device;

FIG. 8 is a side cross-sectional view of a thermal barrier adapted to extend above the heating device to provide thermal protection to a combustionable wall and adjoining ceilings in proximity to a heating device.

DESCRIPTION OF THE PREFERRED EMBODIMENT

Figure 1:
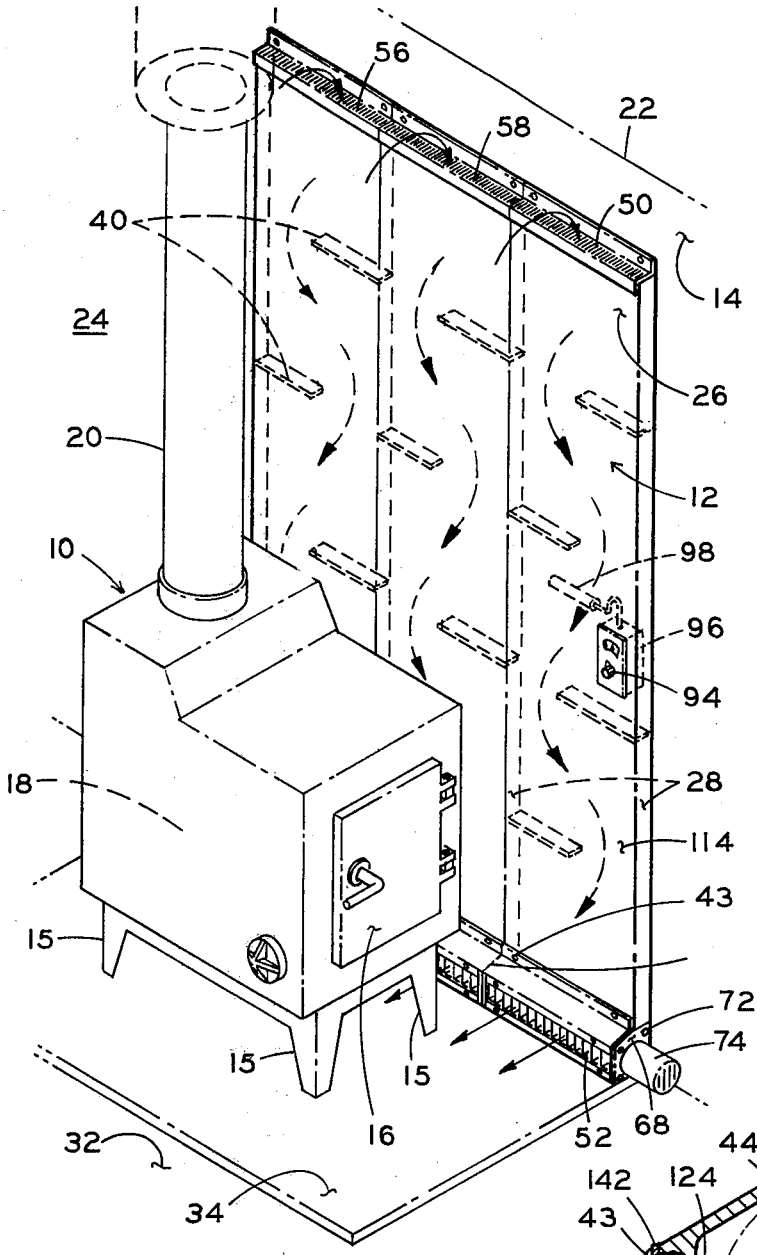
FIG. 1 is a perspective view of one embodiment of the thermal barrier in proximity to a free-standing heating device, adapted with thermostat control to provide thermal protection to a combustionable wall in proximity to the heating device.

The subject matter which I regard as my invention is particularly pointed out and distinctly claimed in the claims. The structure and operation of my invention, together with further objects and adavantages, may be better understood from the following description given in connection with the accompanying drawings in which:

FIG. 1 shows in perspective, a free-standing heating device 10 positioned in proximity to a thermal barrier 12 to provide safe operation of the heating device 10 in close relation to a combustionable wall 14. The heating device 10 may be any conventional free-standing heating device, such as a stove, fireplace, furnace, oven, or the like. Heating device 10 typically has supporting feet or base 15, an access door 16, a combustion chamber 18, and an exhaust flue 20, adapted to exhaust combustion gasses from the combustion chamber 18 to atmosphere through ceiling 22 or wall 14 of room 24, when the heating device is consuming a combustionable fuel.

Figure 2:
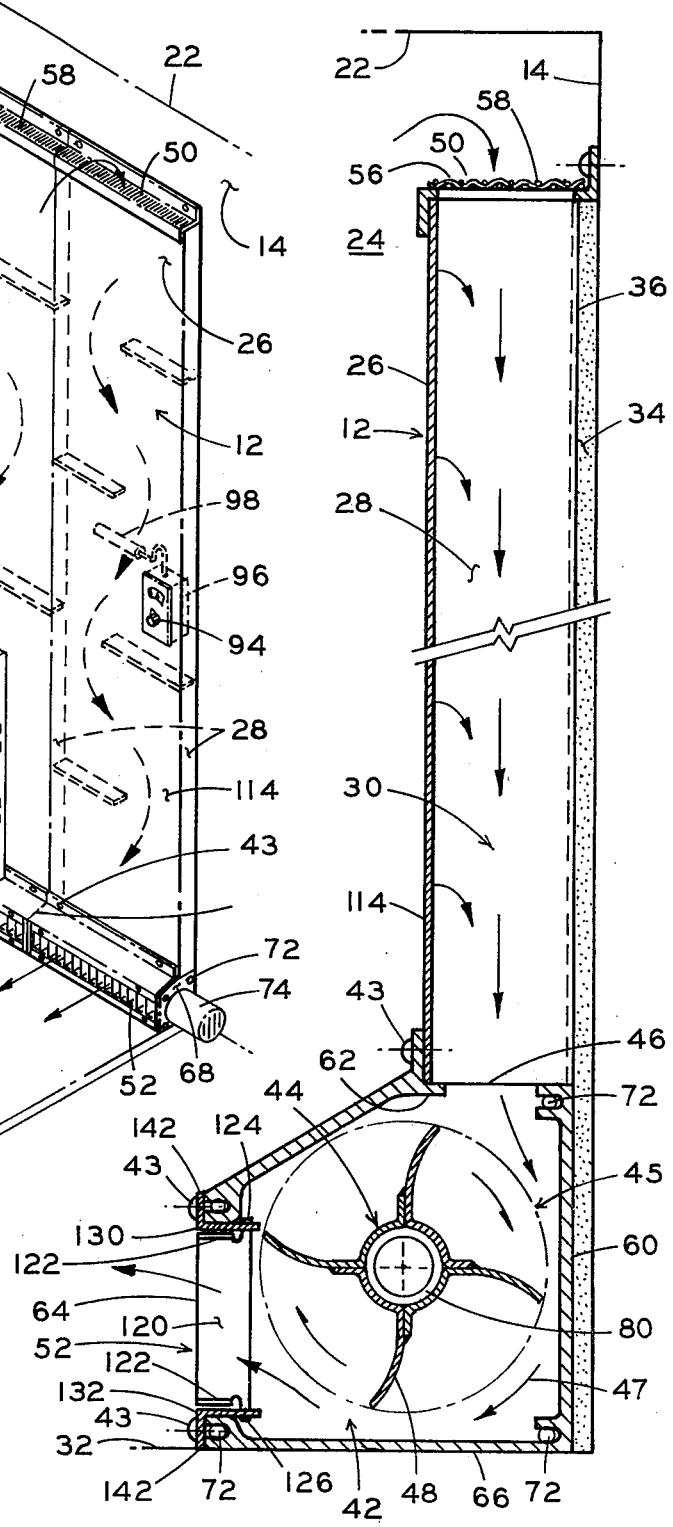
FIG. 2 is an enlarged cross-sectional side elevation view of the embodiment shown in FIG. 1, showing a blower positioned in a chamber at the base of the thermal barrier wherein the blower is adapted to draw heated air downwardly through fluid passages in the thermal barrier, and to disperse the heated air into the room near the floor to improve heat transfer from the thermal barrier to the passing air.

As shown in FIG. 2, thermal barrier 12 has a vertically disposed, heat resistant outer panel 26 adapted to be secured in spaced relation from the combustionable wall 14 by extensions 28, to provide a plurality of vertically disposed fluid passages 30 therethrough.

Outer panel 26 is sized to provide adequate thermal protection to combustionable walls 14 in proximity to a free-standing heating device 10. Panel 26 extends from near the ceiling 22 to near the floor 32.

Outer panel 26 may be fabricated of any suitable heat-resistant material, such as sheet metal, aluminum, asbestos board, ceramic tile, or the like; preferably a highly heat conductive material will be used, such as sheet metal or aluminum. Where a highly heat conductive material is used for outer panel 26, it is preferable to adapt a heat insulating material 34, such as asbestos, ceramic tile, fiberglass, vermiculite, mica, or pressed fiberboard treated to be suitably heat resistant, or the like, for installation to the wall contacting side 36 of thermal barrier 12.

As shown in FIG. 4*a*, outer panel 26 may be spaced apart from combustionable wall 14 by a plurality of individual extensions 28. Such extensions may be any suitable configuration adapted to extend outer panel 26 sufficiently apart from combustionable wall 14 to provide suitable fluid passages 30 therebetween.

As shown in FIG. 4*b*, an inner heat-resistant panel 38 may be adapted to extend from the combustionable wall 14 to outer panel 26 to form fluid passages 30 between extensions 28, outer panel 26, and inner panel 38. In this adaptation, inner panel 38 is ribbed or otherwise convoluted to extend to abut spaced apart panels 26, to form suitable fluid passages 30 therebetween. In this adaptation, two partitions are adapted to be joined at installation to form the thermal barrier 12.

As shown in FIG. 4*c*, both inner and outer panels 26, 38 are adapted to extend to form a plurality of fluid passages 30 therebetween. In this adaptation, an insulating material 34 is adapted for securement to inner panel 38 for added thermal protection. Outer panel 26 is adapted to form opposing side extensions 27, 29 with abutting ends 31, 33 to engage opposed extending tabs 37, 39 of inner panel 38 to form fluid passages 30 therebetween. Three thermal partitions are adapted to be joined at installation to form thermal barrier 12.

As shown in FIG. 4*d*, outer panel 26 is adapted to form opposing side extension 27, 29 with abutting ends 31, 33 adapted for securement to a thermal insulating barrier 34. In this adaptation, four partitions with suitable fluid passages 30 are adapted to be joined at installation.

As shown in FIG. 4*e*, outer panel 26 is adapted to be ribbed or otherwise convoluted to extend to insulating barrier 34 to form suitable fluid passages 30 therebetween. In this adaptation, the outer panel is contoured, ribbed or otherwise convoluted for decorative effect. Panel 26 has side extensions 27, 29 adapted to extend to abut insulating barrier 34. Ends 31, 33 of side extensions 27, 29 are adapted to extend along the vertical sides of insulating barrier 34 to abut combustionable wall 14, to enclose and protect sides of insulating material 34.

Thermal barrier 12 may be assembled at installation from separate modular component parts, or may be preassembled in a thermal barrier assembly to suit manufacturing and customer preferances. Preferably, thermal protection will be provided by several modular thermal partitions from eight to fifty inches wide, with each partition adapted to be joined and secured to wall 14 at installation to form thermal barrier 12. Thermal barrier 12 may readily be adapted for corner installation, or other nonaligned adjoining wall applications. Where required, exhaust flue 20 extending from heating device 10, may be adapted to extend through thermal barrier 12 or extended ceiling chamber 42 to suit installation.

Preferably, the vertically disposed outer panel 26 is adapted to be spaced apart from the room wall 14 by extensions 28 to form fluid passages 30 therebetween having from one-half to six inch spacing between the outer panel 28 and the room wall 14.

Fluid passages 30, may be adapted with internal baffles 40 to increase the distance the air travels through the fluid passages 30 as the air traverses from near the ceiling 22 to near the floor 32 to increase heat transfer from panel 26 to the passing air.

Chamber 42 is adapted to be in fluid communication with fluid passages 30, preferably near the floor 32 or ceiling 22. Chamber 42 may be located in relation to thermal barrier 12 to suit manufacturing or consumer preferance, or for ease of electrical hookup.

An air blower 44 is adapted to be in fluid communication with chamber 42 and room air. Blower 44 is adapted to be installed in relation to chamber 42, and adapted to draw air from near the ceiling in proximity to the heating device 10 downwardly through apertures 30 in thermal barrier 12, to exhaust the air into room 24 near the floor 32.

As shown in FIGS. 1 and 2, chamber 42 is adapted to extend beneath thermal barrier 12 to receive air from fluid passages 30 through aperture port 46, drawn by rotating blades 48 of blower 44, in the direction of arrows 47. Air is exhausted from chamber 42 by the rotation of blades 48 where the air exhausts through room ports 50 into room 24 near the floor 32.

Chamber 42 may be secured to outer panel 26 with screws 43, or other conventional means.

Where chamber 42 is adapted for installation near the ceiling 22, as shown in FIG. 5, the rotation of blower blades 48 is reversed as shown by arrow 47 so that air is drawn from the room 24 near the ceiling 22 through room port 50, where the air passes through aperture port 46 into fluid passages 30, whereupon the heated air is exhausted from fluid passages 30 into room 24 near the floor. The air exhaust port 52 is located near floor 32, and may be adapted with adjustable louvers, or other air directing means 54 to adjustably direct the exhausting air into room 24 to suit occupant preferance.

The air inlet port 56, located near ceiling 22, may be adapted to be screened or otherwise provided with a porous barrier 58 to provide air access therethrough while inhibiting the passage of larger objects that might restrict air flow through fluid passages 30, or damage blower 44.

As shown in FIG. 2, chamber 42 typically has a wall confronting side 60, an aperture port side 62, a room port side 64, and a fourth side 66 adapted to enclose blades 48 therebetween. Chamber ends 68, 70 are adapted to be secured to chamber sides with screws 72 or other conventional fastening means to substantially enclose blower 44 within chamber 42. Blower motor 74 may be externally mounted as shown in FIG. 1, or may be internally mounted as shown in FIGS. 6 or 7.

As shown in FIG. 3, blower blades 48 are preferably rotatably secured between opposing ends 68, 70 of chamber 42 by bearings 76 mounted in holes 78. Sleeve 80 is adapted to engage bearings 76, and to be secured by pin 84, keyway, or other conventional means to the axial core of blades 48. The end 86 of blades 48 is spaced from bearing 76 by washer 88. Blower motor 74 is adapted with rotating driveshaft 90 to slidably engage and secure to sleeve 80. Thus, blower assembly 45 may be preassembled in chamber 42, prior to shipping, aligned at installation, and one motor 74 adapted to drive more than one blower 44 by securing in-line blower blades 48 and sleeve 80 to blower shaft 92 with pins 84, keyways, or secured by other conventional means.

Preferably, blower blades 48 are inclined toward the direction of rotation, as shown in FIG. 2, for quiet operation.

Blower motor 74 may be electrically powered and remotely actuated by a switch 94. For best results, blower 44 should be sized to provide from one to ten cubic feet per minute per square foot of room area to be heated. Blower 44 may be adapted to provide a single rotational speed, or may be adapted to provide more than one selective blower speed for variable volume output.

A thermostatic control device 96 may be adapted with a temperature probe 98 to automatically actuate blower 44 when temperature in proximity to the thermal probe 98 exceeds a selected temperature range.

Where thermal protection is desired beneath the heating device 10 to protect combustionable floor 32, chamber 42 may be adapted to be located upon floor 32 and to extend sufficiently beneath and beyond heating device 10 to provide adequate thermal protection to combustionable floors 32 in proximity to heating device 10. In this adaptation, as shown in FIG. 6, blower 44 may be independently enclosed within chamber 42, with blower inlet port 100 adapted to be in fluid communication with aperture port 46, and exhaust port 102 adapted to be in fluid communication with room port 52. The raised, horizontally disposed heat-resistant chamber wall port side 62, should be adapted to support the heating device 10 thereon. A plenum 104 may be adapted with a plurality of apertures 106 therethrough, to be disposed between thermal wall apertures 30 and blower inlet port 100 to more evenly distribute air through the thermal barrier 12. Where a plenum is used, the combined cross-sectional area of the plenum apertures 106 should be not less than one-half nor more than four times the cross-sectional area of blower inlet port 100. Ideally, the combined cross-sectional area of the plenum apertures 106 should be substantially the same or less than twice as large as the cross-sectional area of the blower inlet port 100.

Where thermal protection is desired above the heating device 10 as shown in FIG. 7, chamber 42 may be adapted to be located near ceiling 22 and extend above and beyond heating device 10 to provide adequate thermal protection to combustable ceiling 22 in proximity to heating device 10. In this adaptation, blower 44 may be independently enclosed within chamber 42, with blower inlet port 100 adapted to be in fluid communication with room port 50, and blower exhaust port 102 adapted to be in fluid communication with aperture port 46. A plenum 104 may be adapted with a plurality of apertures 106 therethrough, to be disposed between the blower exhaust port 102 and wall apertures 30 to more evenly distribute the air through the thermal barrier 12.

Where it is desirable to provide thermal protection to the wall, floor and ceiling, this apparatus may be adapted with both floor and ceiling chambers, as previously disclosed. In this adaptation, only one blower 44 is needed, and may be located at either floor 32 or ceiling 22 locations to suit.

Blower 44 should be installed with a means to provide accessibility to the blower for maintenance or repair following installation. A separate access cover 110 may be used, or access may be provided by removal of the screen, louvers, or other porous covering 112 secured to air inlets or exhaust apertures in proximity to blower 44.

The thermal barrier 12 may be primed, coated, or otherwise treated to receive a suitable heat-resistant covering 114 prior to or following installation, and may be adapted to receive a textured surface, such as tile, simulated brick, slate, or other heat-resistant covering 114 to suit consumer preferance.

Figure 9:
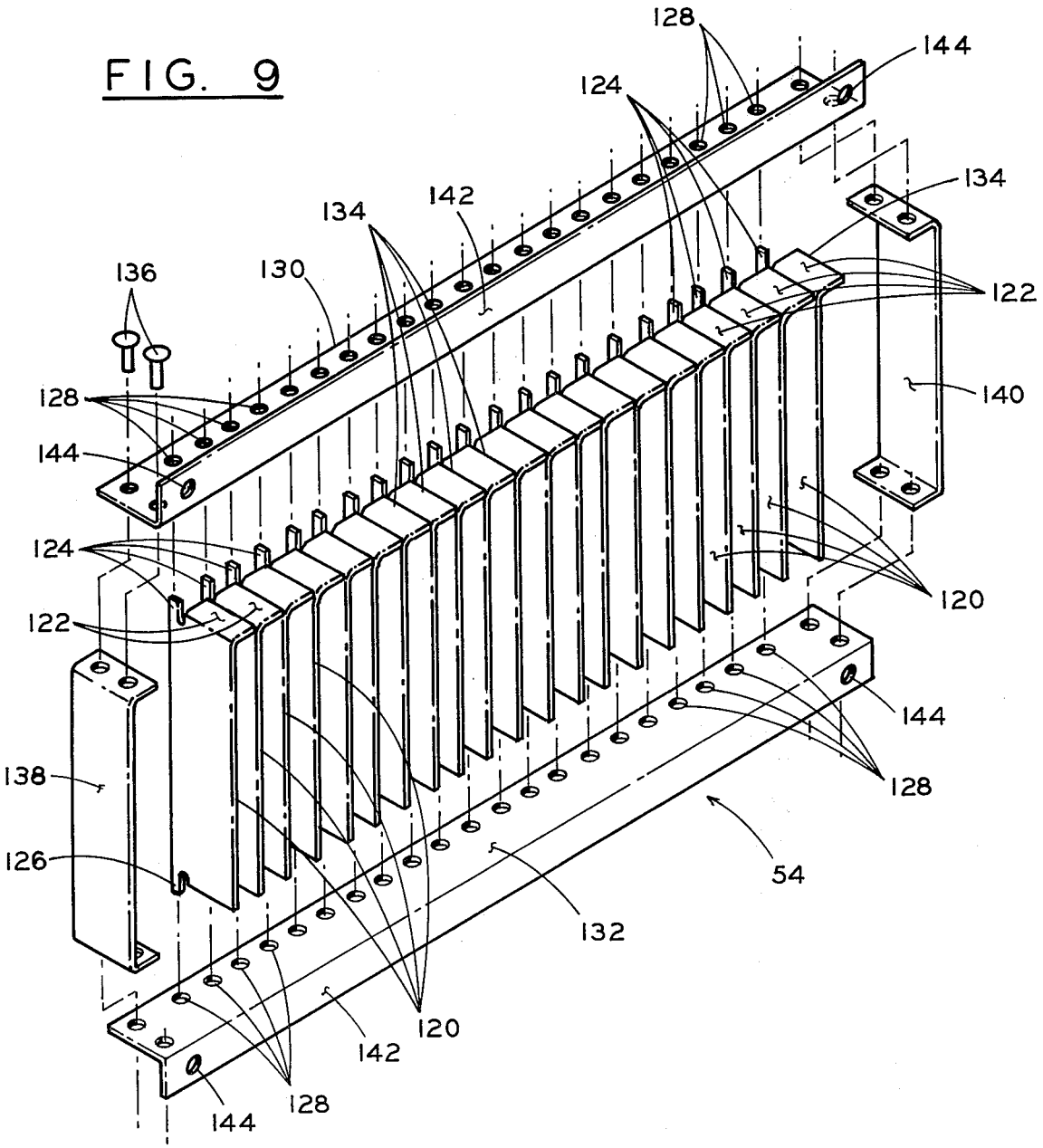
FIG. 9 is an exploded perspective view of the preformed embodiment of the air flow directing means.

The preferred airflow directing means 54 as shown in FIG. 2 and 9 has a plurality of individual louvers 120 adapted to be stamped or otherwise formed with at least one inclined tab 122 sized to extend substantially toward the next adjoining louver 120. Opposed extending tabs 124, 126 are adapted to extend beyond inclined tabs 122 to be pivotally secured within an associated aperture 128 appropriately spaced in opposing brackets 130, 132.

Thus by pivotally biasing any assembled louver 120 in airflow directing means 54, the end 134 of inclined tab 122 abuts the adjoining louver 120, serving to consecutively bias all associated louvers 120 in near parallel alignment, thus diverting air passing therethrough in the direction of the plurality of biased louvers.

Opposing brackets 130, 132 may be readily secured with screws, rivets, spot welding or other conventional fastening means 136 to end brackets 138, 140, posts, extensions or other conventional spaced retaining means to pivotally retain opposed extending tabs 124, 126 in aperture 128 between opposing brackets 130, 132. Opposing brackets 130, 132 may be readily adapted to provide a mounting flange 142 with mounting apertures 144 therethrough for ease of installation. Thus, all linkages and other conventional joining means used to bias one louver 120 in relation to its associated louver 120 is eliminated, conserving both material and labor, thereby reducing overall costs of fabrication, while providing an easily adjustable airflow directing means 54.

This apparatus may be adapted to be installed as a single, prefabricated unit, or may be formed of modular elements, adapted to be joined together and secured at installation. Where modular elements are employed, individual component parts may be separately sold, with the consumer mixing and matching elements to suit a variety of installations.

Thermal barriers 12 may be adapted to be secured at installation to room wall 14 by screwing, nailing, bonding, double-sided tape, the use of suitable brackets, or by other conventional fastening means.

With this apparatus installed in proximity to a free-standing heating device 10, the heating device may be safely positioned closer to thermal barrier 12, thereby conserving valuable room space. In operation, this thermal barrier actively draws heated air from near the ceiling 22 in proximity to heating device 10, downwardly through fluid passages 30 in thermal barrier 12, drawing heat by convection from the outer panel 26 into the passing air, effectively dissipating the heat radiating from the heating device toward the nearby combustionable wall 14, while dispersing the heated air into the room, near the floor 32, where it is needed for occupant comfort.

The user of this thermal barrier should consult local building codes, and the recommended clearance requirements of the selected heating device to determine the suitable dimensions of thermal protection required for a particular application.

It is understood that one skilled in the art may selectively combine features of the several embodiments herein disclosed, and such combinations are intended to be included within the scope of the following claims. Therefore, while the invention has been described with reference to a particular embodiment, it is to be understood that modifications may be made without departing from the spirit of the invention or the scope of the claims.

What is claimed is:

1. An apparatus for actively dispersing heated air in spaced proximity to a free-standing heating device installed in a room having combustionable materials forming at least in part a floor, a ceiling, and a plurality of walls therebetween, which comprises:

(a) a vertically disposed heat-resistant room confronting outer panel adapted to extend from near the ceiling to near the floor in spaced relation from the room wall, and adapted to extend along the wall a distance sufficient to provide suitable thermal protection to the combustionable wall in spaced proximity to the heating device;

(b) a vertically disposed, heat resistant wall confronting inner panel, said inner panel adapted with a plurality of vertically disposed spaced apart convolutions adapted to extend to abut said outer panel in a manner to form a plurality of vertically aligned fluid passages between said inner and outer panels and said convolutions;

(c) a horizontal chamber having opposing sides and ends, and adapted to extend substantially across one end of the vertically aligned fluid passages; and (d) an air blower adapted with an inlet and outlet port, with one port adapted to be in fluid communication with the horizontally disposed chamber, and the other port adapted to be in fluid communication with the room air, said inlet and outlet ports positioned in relation to the horizontal chamber in a manner to force air downwardly through the plurality of vertically aligned fluid passages to draw radiant heat from the heating device through the outer panel by conduction, and to disperse the heat by convection to the passing air, wherein: the heat resistant outer panel provides thermal protection to the combustionable wall in proximity to the heating device, allowing closer positioning of the heating device in relation to the heat resistant outer panel to provide safe installation while conserving room space; and providing active disbursement of the heated room air from near the ceiling in proximity to the heating device, through the vertically aligned fluid passages to exhaust the heated air back into the room, near the floor, where it is needed for occupant comfort.

2. The apparatus of claim 1, wherein the chamber is adapted with extending sides and a horizontally disposed raised heat resistant supporting surface in spaced relation above the floor, said chamber adapted to extend beneath and beyond the heating device to support the device thereon, and to provide thermal protection to the combustionable floors a safe distance from said heating device.

3. The apparatus of claim 1, wherein the chamber is adapted with extending sides and a lowered horizontally disposed heat-resistant ceiling surface in spaced relation below said ceiling, said chamber adapted to extend above and beyond the heating device to provide thermal protection to the combustionable ceiling a safe distance from said heating device.

4. The apparatus of claim 1, wherein the heat-resistant panel is adapted to conform to adjoining room walls to provide for nonaligned wall installation.

5. The apparatus fo claim 1, wherein a heat resistant insulating material is adapted to be secured between the thermal barrier and the combustionable room wall.

6. The apparatus of claim 1, wherein the chamber is adapted to have a plenum with a plurality of spaced apart apertures in fluid communication with each fluid passage in said thermal barrier, said aperture sized to more equally distribute the air through the fluid passages for more uniform heat transfer, wherein the combined cross-sectional area of the chamber apertures are from one-half to four times the cross-sectional area of the blower inlet port.

7. The apparatus of claim 1, wherein the air blower is adapted to be remotely actuated by a thermostat control having a temperature sensing probe in close proximity to the fluid passages, said thermostat control adapted to actuate the blower when the temperature in proximity to the temperature sensing probe exceeds a desired selected temperature range.

8. The apparatus of claim 1, wherein the output of the blower is adapted to provide a volume of air flow selected from a range of from one to ten cubic feet per minute per square foot of room area to be heated.

9. The apparatus of claim 1, wherein the air blower is adapted to selectively provide more than one volume of air flow.

10. The apparatus of claim 1, wherein the heated air is exhausted from the apparatus, near the floor, through a manually controlled air directing device adapted to adjustably divert the exhausting air in different room directions.

11. The apparatus of claim 1, wherein the inlet air entering the apparatus near the ceiling passes through a porous, protective covering adapted to restrict passage of larger objects therethrough.

12. The apparatus of claim 1, wherein the vertically disposed outer panel is spaced apart from the room wall confronting surface from one-half to six inches to form suitable fluid passages therebetween.

13. The apparatus of claim 10, wherein the air directing device comprises:

a plurality of elongated louvers having sides and ends, said louver adapted with an inclined tab, sized to substantially extend to abut an adjoining louver; and opposed extending tabs, adapted to extend beyond the ends of the louver;

a pair of opposing brackets adapted to be spaced apart, with a plurality of opposing apertures therethrough, adapted to pivotally receive and secure the opposed extending tabs;

wherein said louver may be biased causing the inclined tab to consecutively bias each adjoining louver in near parallel alignment, serving to divert passing air in the direction of the plurality of biased louvers.

14. The apparatus of claim 1, wherein the room confronting outer panel is adapted with a plurality of vertically disposed spaced apart convolutions adapted to extend to abut said inner panel in a manner to form a plurality of vertically aligned fluid passages between said inner and outer panels and said convolutions.

15. The apparatus of claim 14, wherein a heat resistant insulating material is adapted to serve in place of said inner panel in a manner to form a plurality of vertically aligned fluid passages between said outer panel, said convolutions in said outer panel and said insulating material.

* * * * *